US010333222B2

(12) United States Patent
Kim et al.

(10) Patent No.: US 10,333,222 B2
(45) Date of Patent: Jun. 25, 2019

(54) METHOD OF IMPROVING BANDWIDTH OF ANTENNA USING TRANSMISSION LINE STUB

(71) Applicant: Electronics and Telecommunications Research Institute, Daejeon (KR)

(72) Inventors: Eun Hee Kim, Daejeon (KR); Ju Derk Park, Daejeon (KR); In Hwan Lee, Daejeon (KR); Ho Yong Kang, Daejeon (KR); Jae Heum Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 18 days.

(21) Appl. No.: 15/484,449

(22) Filed: Apr. 11, 2017

(65) Prior Publication Data

US 2017/0294711 A1 Oct. 12, 2017

(30) Foreign Application Priority Data

Apr. 11, 2016 (KR) ..... 10-2016-0044143
Feb. 9, 2017 (KR) ..... 10-2017-0018230

(51) Int. Cl.
*H01Q 5/50* (2015.01)
*H01P 3/08* (2006.01)
*H01P 1/203* (2006.01)

(52) U.S. Cl.
CPC ..... *H01Q 5/50* (2015.01); *H01P 1/2039* (2013.01); *H01P 1/20363* (2013.01); *H01P 3/08* (2013.01)

(58) Field of Classification Search
CPC ..... G01Q 5/50; H01Q 9/285; H01Q 1/526
USPC ..... 343/905, 853; 455/566
See application file for complete search history.

(56) References Cited

U.S. PATENT DOCUMENTS

| | | | | |
|---|---|---|---|---|
| 7,782,257 | B2 | 8/2010 | Kim et al. | |
| 9,564,870 | B2 * | 2/2017 | Kasahara | H01P 1/2005 |
| 9,825,357 | B2 * | 11/2017 | Parsche | H01Q 1/526 |
| 2005/0116867 | A1 | 6/2005 | Park et al. | |
| 2008/0024247 | A1 * | 1/2008 | Mei | H01P 1/20381 333/202 |
| 2009/0135077 | A1 | 5/2009 | Kim et al. | |
| 2009/0174608 | A1 | 7/2009 | Park et al. | |
| 2010/0127951 | A1 | 5/2010 | Robert et al. | |

(Continued)

FOREIGN PATENT DOCUMENTS

| | | |
|---|---|---|
| JP | 2010-534438 | 11/2010 |
| KR | 10-2001-0073660 A | 8/2001 |

(Continued)

OTHER PUBLICATIONS

Korean Office Action dated Mar. 30, 2018, in corresponding Korean Application No. 10-2017-0018230 (4 pages, in Korean).

(Continued)

*Primary Examiner* — Peguy Jean Pierre
(74) *Attorney, Agent, or Firm* — NSIP Law

(57) ABSTRACT

Provided is a method of improving a bandwidth of an antenna using a transmission line stub to enable long-range communication together with broadband matching. According to the method, it is possible to combine a transmission line stub in series or parallel with a feeding point, which is an antenna signal input/output point of a body serving as an antenna, and apply the transmission line stub to an antenna for wide use.

8 Claims, 11 Drawing Sheets

(56) References Cited

U.S. PATENT DOCUMENTS

| | | | | |
|---|---|---|---|---|
| 2011/0300907 | A1* | 12/2011 | Hill | H01Q 9/285<br>455/566 |
| 2016/0104945 | A1* | 4/2016 | Wang | H04B 1/18<br>343/853 |

FOREIGN PATENT DOCUMENTS

| | | | |
|---|---|---|---|
| KR | 10-2005-0025903 | A | 3/2005 |
| KR | 10-2006-0076575 | A | 7/2006 |
| KR | 10-2007-0089579 | | 8/2007 |
| KR | 10-0782301 | B1 | 12/2007 |
| KR | 10-0998603 | B1 | 11/2010 |
| KR | 10-1248670 | B1 | 3/2013 |
| KR | 10-1288381 | B1 | 7/2013 |
| KR | 10-2015-0030009 | A | 3/2015 |

OTHER PUBLICATIONS

Korean Notice of Allowance dated Sep. 19, 2018 in counterpart Korean Patent Application No. 10-2017-0018230. (2 pages in Korean).

* cited by examiner

METHOD OF IMPROVING BANDWIDTH OF ANTENNA USING TRANSMISSION LINE STUB

CROSS-REFERENCE TO RELATED APPLICATION

This application claims priority to and the benefit of Korean Patent Application No. 10-2016-0044143, filed on Apr. 11, 2016, and No. 10-2017-0018230, filed on Feb. 9, 2017, the disclosure of which is incorporated herein by reference in its entirety.

BACKGROUND

1. Field of the Invention

The present invention relates to a method of improving a bandwidth of an antenna using a transmission line stub, and more particularly, to a method of improving a bandwidth of an antenna using a transmission line stub in which it is possible to improve a bandwidth of a small resonant antenna with a high quality factor (Q) using a λ/4 transmission line stub.

2. Discussion of Related Art

Generally, an antenna has a resonance characteristic and thus has a finite impedance bandwidth. An impedance bandwidth of an antenna should be sufficiently larger than a bandwidth of a signal to be transmitted. Therefore, a variety of methods are used to increase an impedance bandwidth of an antenna.

In particular, an antenna has a finite impedance bandwidth due to a unique resonance characteristic thereof. An impedance bandwidth of an antenna results from a difference between a frequency-dependent impedance of the antenna and an impedance of a power source or a load connected to the antenna, and is shown in Expression 1 below.

$$\text{Impedance Bandwith} = \frac{1}{Q}\frac{S-1}{\sqrt{S}} \quad \text{[Expression 1]}$$

Here, Q is a quality factor of an antenna, and S is a voltage standing wave ratio (VSWR) depending on a difference between an antenna impedance and a power source/load impedance.

To increase an impedance bandwidth of an antenna, a quality factor of an antenna impedance should be reduced. In general, the smaller an antenna size with respect to an operating wavelength, the larger a quality factor of an antenna impedance. Therefore, to transmit a large-bandwidth signal using a small antenna, it is necessary to reduce a quality factor of an antenna impedance.

Referring to a related art, a stub disclosed in Korean Patent Publication No. 10-2006-0076575 is not a transmission line stub disclosed in the present invention. Referring to FIG. 2 of Korean Patent Publication No. 10-2006-0076575, a sub-radiator Zb connected in parallel with a main radiator Za is referred to as a stub. However, this is not a transmission line stub, and indicates a bump protruding from the main radiator. This is the same as a radiator (likewise, simply referred to as a stub) connected in parallel with a radiator of FIG. 2 in US Patent Publication No. 2009-0174608.

A stub disclosed in Korean Patent Publication No. 10-2015-0030009 is a structure in the form of a bump which is inserted into a feeding portion of an antenna, and totally differs from transmission line stubs disclosed in the present invention. The impedance of the antenna may be adjusted by variously changing a shape of the feeding portion as shown in FIGS. 4 and 5 of Korean Patent Publication No. 10-2015-0030009, and the various shapes of the feeding portion are simply referred to as stubs.

A stub disclosed in U.S. Pat. No. 7,782,257 is also a structure (see 22 of FIG. 2) in the form of a bump which is added to a multilayer loop antenna, and totally differs from transmission line stubs disclosed in the present invention. In other words, all of the stubs disclosed in Korean Patent Publication No. 10-2006-0076575, Korean Patent Publication No. 10-2015-0030009, U.S. Pat. No. 7,782,257, and US Patent Publication No. 2009-0174608 may be irrelevant to λ/4 transmission line stubs of the present invention.

Consequently, there is an urgent need to develop a method for improving a bandwidth of a small resonant antenna with a high quality factor (Q).

SUMMARY OF THE INVENTION

The present invention is directed to providing a method of improving a bandwidth of an antenna using a transmission line stub in which it is possible to provide an omnidirectional characteristic to a body having the transmission line stub and reduce a quality factor of an antenna impedance by combining the transmission line stub in series or parallel with a feeding point of the body, and thus it is possible to efficiently transmit a broadband signal with a relatively small body, show the omnidirectional characteristic, and perform long-range communication together with broadband matching.

According to an aspect of the present invention, there is provided a method of improving a bandwidth of an antenna using a transmission line stub, the method being a method of improving a bandwidth of a body serving as an antenna and including: combining a transmission line stub in series or parallel with a feeding point, which is an antenna signal input/output point of a body, and applying the transmission line stub to an antenna for wide use.

The transmission line stub may be obtained by connecting a plurality of transmission lines having characteristic impedances corresponding to different lengths in series to increase an impedance bandwidth of the antenna including the body and reduce a quality factor of an antenna impedance or an antenna admittance of the body.

The number of transmission lines of the transmission line stub connected in series may be increased to reduce the quality factor of the antenna impedance or the antenna admittance.

A characteristic impedance may be continuously changed by lengthening or shortening lengths of the transmission lines of the transmission line stub connected in series to reduce the quality factor of the antenna impedance or the antenna admittance.

The transmission line stub may be a serial transmission line stub combined in series with the feeding point, and a stub positioned between both ends of the serial transmission line stub may have a larger strip width than other stubs positioned at the both ends thereof.

The transmission line stub may be an open transmission line stub combined in parallel with the feeding point, and may include first transmission lines having straight structures symmetrically extending in diametric directions of the body from the feeding point, second transmission lines having arc structures extending along a circumferential direction of the body from ends of the respective first transmission lines, and third transmission lines having meander strip structures formed along the circumferential direction at ends of the second transmission lines.

The transmission line stub may be a serial stub having one end which is open and having a length which is an odd-number multiple, or a serial stub having one end which is shorted and having a length which is an even-number multiple.

The transmission line stub may be a parallel stub having one end which is open and having a length which is an even-number multiple, or a parallel stub having one end which is shorted and having a length which is an odd-number multiple.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Advantages and features of the present invention and a method of achieving the same should be clearly understood from embodiments described below in detail with reference to the accompanying drawings. However, the present invention is not limited to the following embodiments and may be implemented in various different forms. The embodiments are provided merely for complete disclosure of the present invention and to fully convey the scope of the invention to those of ordinary skill in the art to which the present invention pertains. The present invention is defined by the claims.

Meanwhile, terminology and length of a transmission line used herein is for the purpose of describing the embodiments and is not intended to be limiting to the invention. As used herein, the singular form of a word includes the plural form unless clearly indicated otherwise by context. The term "comprise" and/or "comprising," when used herein, does not preclude the presence or addition of one or more components, steps, operations, and/or elements other than the stated components, steps, operations, and/or elements.

A body which is an antenna and will be described below may be any one of various forms of a general antenna and has a characteristic in that it is possible to apply λ/4 transmission line stubs to any antenna requiring bandwidth improvement of a body for wide use by, for example, combining the λ/4 transmission line stubs in series or parallel with a feeding point which is an antenna signal input/output point of the body.

Figure 1:
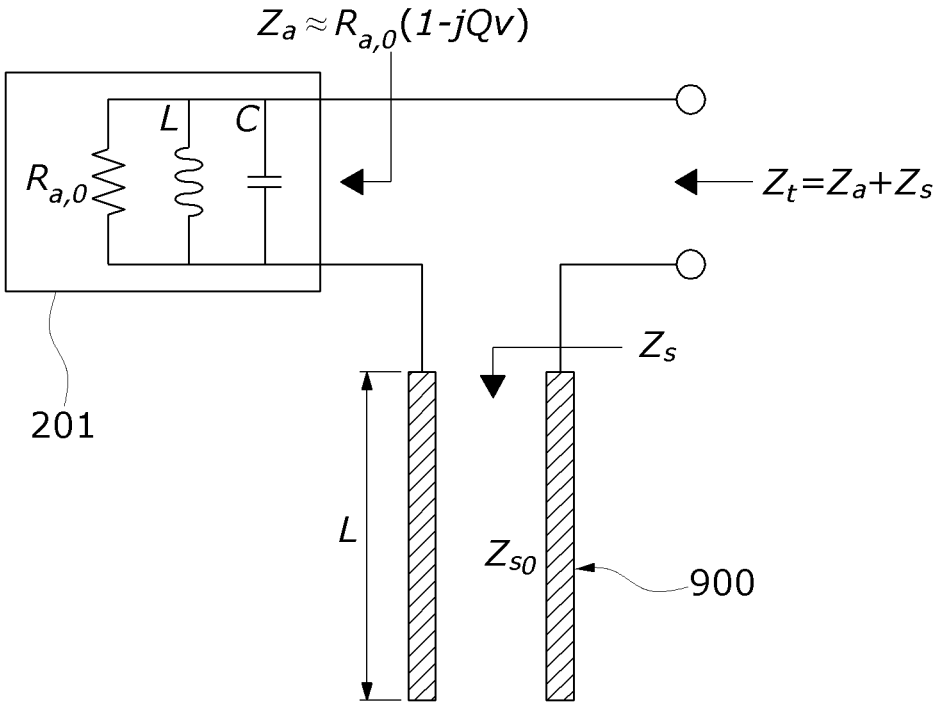
FIG. 1 is a circuit diagram showing a method of improving an impedance bandwidth of an antenna using a serial λ/4 transmission line stub according to an exemplary embodiment of the present invention.
Figure 2:
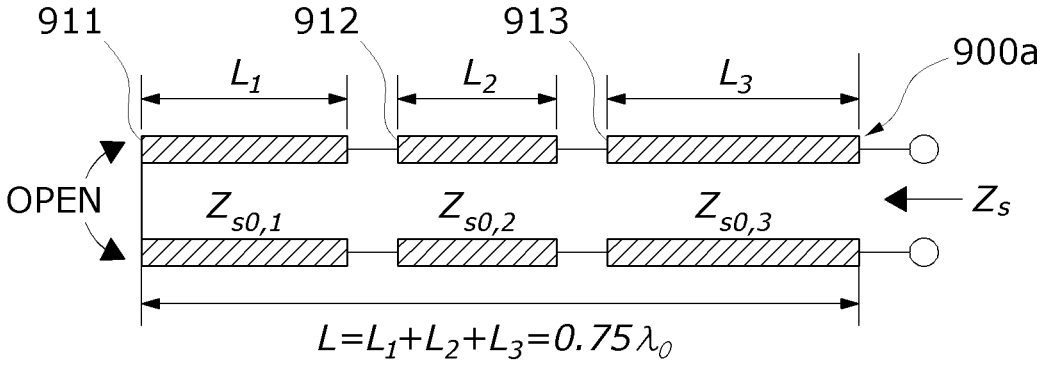
FIG. 2 is a circuit diagram of open λ/4 transmission line stubs that may be applied to the circuit diagram shown in FIG. 1, have different lengths and characteristic impedances, and are composed of serial connections of three kinds of transmission line.

FIG. 1 is a circuit diagram showing a method of improving an impedance bandwidth of an antenna using a serial λ/4 transmission line stub according to an exemplary embodiment of the present invention, and FIG. 2 is a circuit diagram of open λ/4 transmission line stubs that may be applied to the circuit diagram shown in FIG. 1, have different lengths and characteristic impedances, and are composed of serial connections of three kinds of transmission line.

As shown in FIG. 1, an equivalent impedance $Z_a$ of an antenna (e.g., a parallel resonant antenna), which is referred to as a body 201 in the description of the present embodiment, around a resonant frequency $f_0$ may be indicated by Expression 2 below.

$$Z_a \approx R_{a,0}(1 - jQv), \quad \text{where} \qquad \text{[Expression 2]}$$

$$v = \frac{f}{f_0} - \frac{f_0}{f} \;\&\; Qv \ll 1$$

Here, $R_{a,0}$ is a resistance component of an impedance of a resonant antenna, and Q is a quality factor of an antenna impedance. The higher Q is, the smaller a bandwidth of the antenna becomes.

Serial λ/4 transmission line stubs 900 connected in series with the body 201 of FIG. 1, which is a parallel resonant antenna, may be short stubs or open stubs.

For example, the λ/4 transmission line stubs 900 may be serial stubs that have one ends that are open and have a length which is an odd-number multiple of λ/4, or serial stubs which have one ends that are shorted and have a length which is an even-number multiple of λ/4.

In the present invention, a λ/4 transmission line stub has a structure obtained by opening or shorting one end of a transmission line for transmitting a high-frequency signal, such as a microstrip line or a strip line, and then connecting the other end in series or parallel with a feed end of an antenna. In general, a λ/4 transmission line stub connected in series with an antenna is referred to as a serial λ/4 transmission line stub, and a λ/4 transmission line stub connected in parallel with an antenna is referred to as a parallel λ/4 transmission line stub.

When a length L of a short stub or an open stub is $0.25(2n-1)\lambda_0$ or $0.5n\lambda_0$, an impedance of the short stub or the open stub around the resonant frequency $f_0$ may be indicated by Expression 3 below.

$$Z_S \approx jk_1 v \quad \text{[Expression 3]}$$

In this expression or description below, n is a positive integer, and $\lambda_0$ is a resonant wavelength. The larger n is, the greater the length L of the 214 transmission line stubs 900 becomes.

Referring to Expression 3 above, when $f=f_0$, $Z_s$ equals 0, and $k_1$ is an inclination of a change in $Z_s$ with respect to a change in v when $f=f_0$.

For example, in the case of an open λ/4 transmission line stub having the length L of $0.25(2n-1)\lambda_0$, an input impedance $Z_S^o$ is indicated by Expression 4 below.

$$Z_s^o = -jZ_{s0}\cot\left(\frac{2\pi L}{\lambda}\right)\Big|_{L=\frac{(2n-1)\lambda_0}{4}} \approx jZ_{s0}\frac{(2n-1)\pi}{4}v = jk_1 v \quad \text{[Expression 4]}$$

Here, $Z_{s0}$ is a characteristic impedance of a transmission line constituting the λ/4 transmission line stub, and $$k_1 \approx Z_{s0}\frac{(2n-1)\pi}{4},$$

which denotes a positive inclination value.

Meanwhile, an input impedance $Z_S^S$ of a short stub having the length L of $0.5n\lambda_0$ is indicated by Expression 5 below.

$$Z_s^s = jZ_{s0}\tan\left(\frac{2\pi L}{\lambda}\right)\Big|_{L=\frac{nL_0}{2}} \approx jZ_{s0}\frac{n\pi}{2}v = jk_1 v \quad \text{[Expression 5]}$$

Here, $$k_1 \approx Z_{s0}\frac{n\pi}{2},$$

which denotes a positive inclination value.

A total impedance $Z_t$ of a parallel resonant antenna and a serial λ/4 transmission line stub is indicated by Expression 6 below.

$$Z_t = Z_a + Z_s \approx R_{a,0} - jR_{a,0}\left(Q - \frac{k_1}{R_{a,0}}\right)v = R_{a,0}(1 - jQ'v) \quad \text{[Expression 6]}$$

Here, $$Q' = Q - \frac{k_1}{R_{a,0}},$$

which denotes a quality factor Q' of a total antenna impedance.

As described above, $k_1$ has a positive value, and thus Q'<Q. Therefore, a total impedance bandwidth of the antenna increases. When a bandwidth enlargement factor is F, F is indicated by Expression 7 below.

$$F = \frac{Q}{Q'} = \frac{R_{a,0}Q}{R_{a,0}Q - k_1} \quad \text{[Expression 7]}$$

Referring to Expression 7, the larger $k_1$ is, the greater the bandwidth enlargement factor F becomes. Referring back to Expression 4 and Expression 5, when the characteristic impedance $Z_{s0}$ of the λ/4 transmission line stub increases, that is, when n increases (i.e., when the length of the λ/4 transmission line stub increases), $k_1$ increases. Accordingly, the bandwidth enlargement factor F increases.

Meanwhile, $Z_{s0}$ is a characteristic impedance of a transmission line constituting the λ/4 transmission line stub. However, it is unnecessary for the λ/4 transmission line stub to have a uniform characteristic impedance over the entire length L.

For example, FIG. 2 shows an example of an open λ/4 transmission line stub having n equal to 2. Here, $L=0.25(2n-1)\lambda_0|_{n=2}=0.75\lambda_0$, and an open λ/4 transmission line stub 900*a* of FIG. 2 is obtained by connecting three kinds of transmission line 911, 912, and 913 having different lengths L1, L2, and L3 and characteristic impedances $Z_{s0,1}$, $Z_{s0,2}$, and $Z_{s0,3}$ in series.

Here, $Z_{s0}$ of Expression 4 and Expression 5 may be equivalently calculated as functions of the different lengths L1, L2, and L3 and the characteristic impedances $Z_{s0,1}$, $Z_{s0,2}$, and $Z_{s0,3}$, and a variety of optimized combinations for increasing $Z_{s0}$ in a limited design space may be derived. Also, the serial λ/4 transmission line stub 900*a* may be designed in various ways, which may be devised by those of ordinary skill in the art, that, for example, increase the number of the serially connected transmission lines 911, 912, and 913 of the serial λ/4 transmission line stub 900*a* or continuously change the characteristic impedances $Z_{s0,1}$, $Z_{s0,2}$, and $Z_{s0,3}$ by increasing or reducing the lengths L1, L2, and L3 of the transmission lines 911, 912, and 913.

Figure 3A:
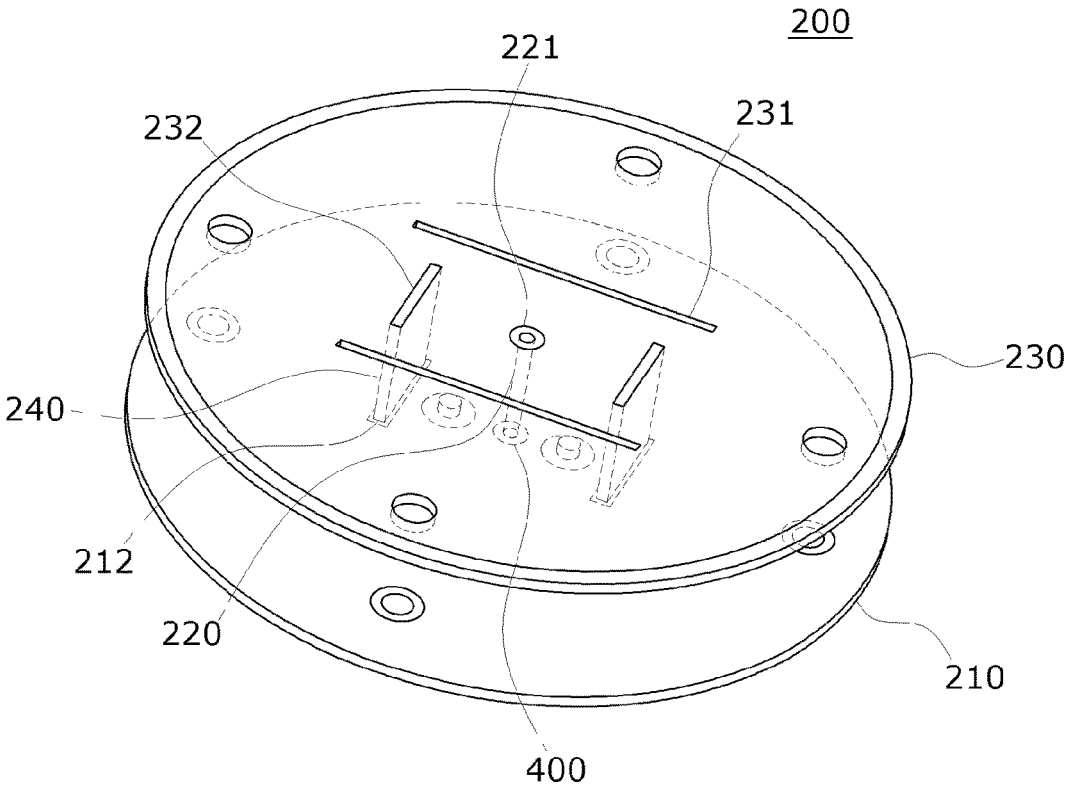
FIG. 3A is a perspective view of a body which is a disk-loaded monopole antenna as a comparative example of the present invention before a λ/4 transmission line stub is applied thereto.
Figure 3B:
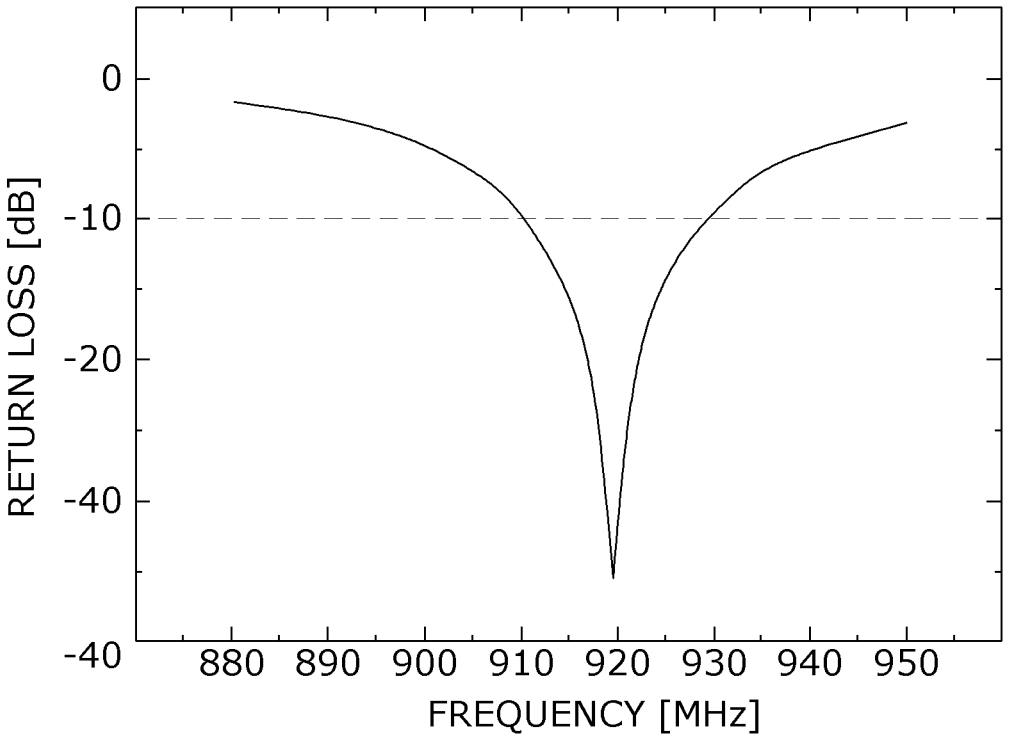
FIG. 3B is a graph showing an impedance matching characteristic of the body shown in FIG. 3A.

FIG. 3A is a perspective view of a body which is a disk-loaded monopole antenna as a comparative example of the present invention before a λ/4 transmission line stub is applied thereto, and FIG. 3B is a graph showing an impedance matching characteristic of the body shown in FIG. 3A. For reference, a disk may correspond to an upper plate 230 or a lower plate 210 shown in FIG. 3A or 4A, and the monopole may correspond to a metal pole 220.

Referring to FIGS. 3A and 3B, a body 200 before application of the λ/4 transmission line stub according to the present embodiment may include the lower plate 210, the metal pole 220, the upper plate 230, and short strips 240.

The body 200 and all bodies mentioned in the present description may be mounted on manhole covers embedded in a ground surface and serve as antennas, and may constitute a wireless sensor network or a wide-area wireless communication network.

As components of the body 200, the lower plate 210, the metal pole 220, the upper plate 230, and the short strips 240 may correspond to metal portions through which a surface current flows.

The lower plate 210 or the upper plate 230 may be formed in a circular shape, and may be formed in any one of various shapes, such as a quadrangle, a hexagon, a polygon, etc., according to a design, that is, the lower plate 210 and the upper plate 230 may not be limited to a specific shape.

The short strips 240 may be one pair as shown in the drawing or multiple pairs according to a design.

A height of the short strips 240 or a distance between the lower plate 210 and the upper plate 230 may be determined to correspond to impedance matching.

The upper plate 230 is a radiator in which at least one or one pair of slots 231 are positioned symmetrically or asymmetrically, and in which a feeding point 221 is positioned. Although not shown in FIG. 3A, the slots 231 may have a form, a shape, and a number depending on a design. Although there are one pair of slots 231 in FIG. 3 by way of example, multiple slots 231 may be at multiple asymmetrical positions.

The feeding point 221 is an antenna signal input/output point. When an open λ/4 transmission line stub 920 is connected to the feeding point 221, it is possible to realize broadband matching as intended by the present invention.

The short strips 240 are symmetrically or asymmetrically disposed between the upper plate 230 and the lower plate 210. Feeding to the upper plate 230 may be performed through the metal pole 220 which is a core of a connector 400. The connector 400 may be connected to a wireless transceiver for sensor access previously installed in a manhole through a non-shown cable. Here, the wireless transceiver may be connected to multiple sensors disposed in the manhole or an underground space. The wireless transceiver may provide an electrical signal corresponding to sensing information input from the sensors to each of bodies 200, 201, 202, 200*a*, and 200*b* mentioned herein through a cable and the connector 400. Here, the connector 400 may be inserted into a cable hole 120 of a manhole cover 100 and fixed with adhesive, a molding material, or the like. Also, the non-shown sensors denote multiple sensor nodes and may be provided to sensing targets (not shown) previously installed in the manhole or the underground space. Each sensor accesses the wireless transceiver by wire or wirelessly and may collect and transmit sensing information of a corresponding sensing target to the wireless transceiver.

The lower plate 210 is disposed on a bottom surface of a recess 110 of the manhole cover 100 on the basis of a cable hole 120 of the manhole cover 100 shown in FIG. 4C described below, and may serve as the ground surface.

The metal pole 220 is the core of the connector 400 as mentioned above and may be a feeding probe. The lower end of the metal pole 220 extends from the connector 400.

As long as the metal pole 220 is at a position where it is possible to connect the lower plate 210 and the upper plate 230 to each other according to a design, the metal pole 220 may perform feeding even when the position is not the center of the lower plate 210 and the upper plate 230.

The metal pole 220 passes through the lower plate 210 and vertically extends up to an upper end of a height corresponding to the distance between the two plates.

The upper plate 230 is connected to an upper end of the metal pole 220, is kept parallel with the lower plate 210, and serves as a radiator.

A point at which the upper plate 230 and the upper end of the metal pole 220 are connected is used as the feeding point 221.

The body 200 may have a smaller diameter than a manhole in consideration of a diameter of a general manhole with a sluice gate. Also, the body 200 may have an impedance bandwidth of about 18 MHz to about 19 MHz with respect to a frequency versus return loss, that is, a return loss of −10 dB.

Figure 4A:
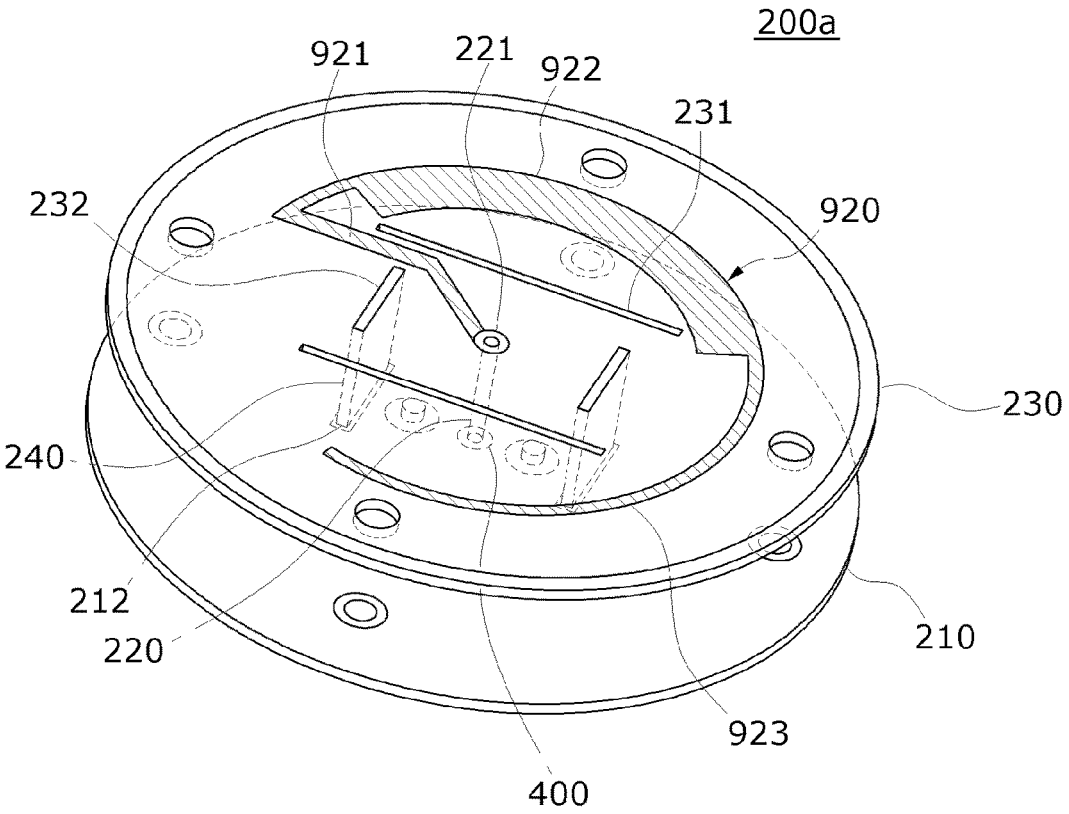
FIG. 4A is a perspective view of a body having an upper plate which is manufactured using a method of improving an impedance bandwidth of an antenna using a λ/4 transmission line stub according to an exemplary embodiment of the present invention and in which open λ/4 transmission line stubs having a positive integer n of 2 are installed in series.
Figure 4B:
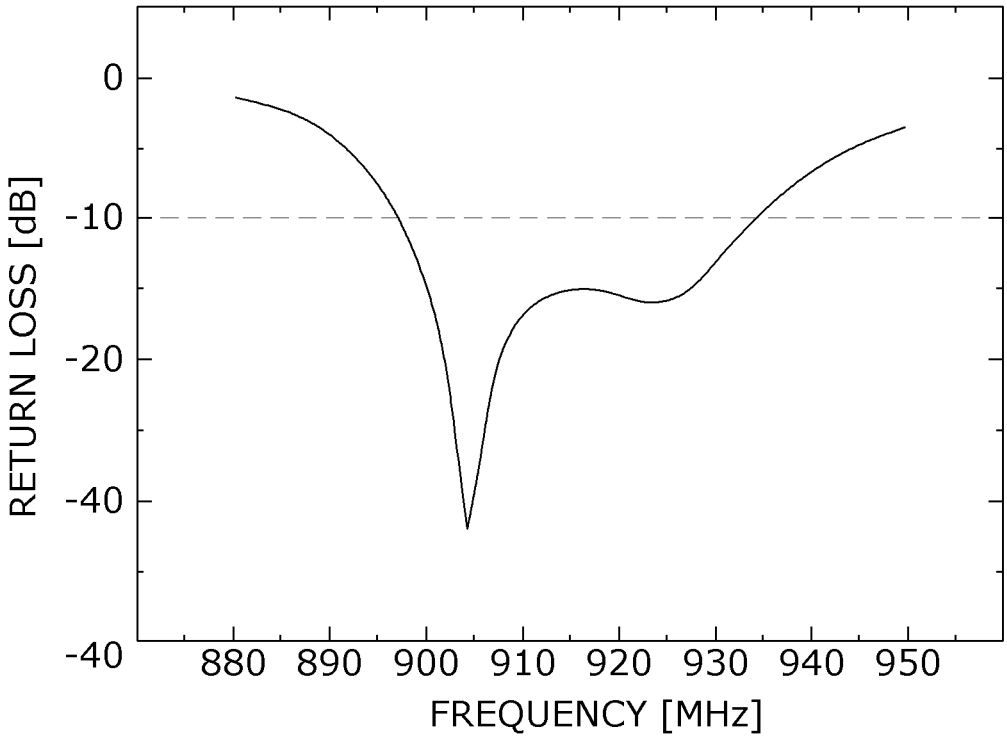
FIG. 4B is a graph showing an impedance matching characteristic of the body shown in FIG. 4A.
Figure 4C:
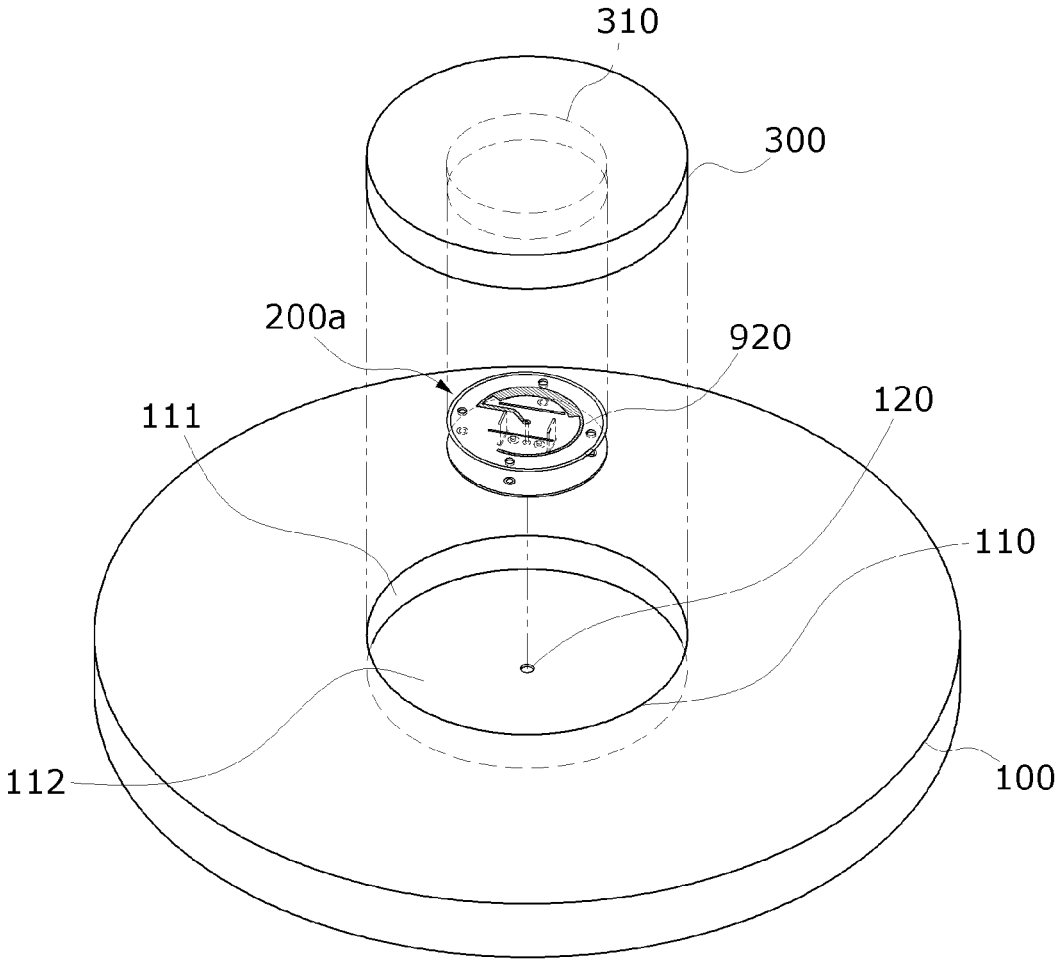
FIG. 4C is an exploded perspective view showing a combination relationship between the body shown in FIG. 4A and a recess in a manhole cover.

FIG. 4A is a perspective view of a body having an upper plate which is manufactured using a method of improving an impedance bandwidth of an antenna using a λ/4 transmission line stub according to an exemplary embodiment of the present invention and in which open λ/4 transmission line stubs having a positive integer n of 2 are installed in series, FIG. 4B is a graph showing an impedance matching characteristic of the body shown in FIG. 4A, and FIG. 4C is an exploded perspective view showing a combination relationship between the body shown in FIG. 4A and a recess in a manhole cover.

Referring to FIG. 4A or 4C, the body 200*a* is also an antenna as described above and may include the lower plate 210, the metal pole 220, the upper plate 230, and the short strips 240.

An upper end of each short strip 240 is inserted into or coupled to an upper coupling hole 232 in the upper plate 230. A lower end of each short strip 240 is inserted into or coupled to a lower coupling hole 212 in the lower plate 210. Here, the coupling may be performed with a welding operation or a coupling method for physically coupling each of the short strips 240 and the coupling holes while maintaining electrical conductivity, and the short strips 240 may be accordingly made electrically conductive.

A direction in which the upper coupling hole 232 and the lower coupling hole 212 are disposed and a direction in which the slots 231 are disposed may cross at right angles.

The upper plate 230 is shorted with respect to the lower plate 210 by the short strips 240.

The slots 231 are formed on the upper plate 230 along a direction perpendicular to a direction in which the short strips 240 are disposed or to be apart from the metal pole 220 without overlapping the short strips 240.

In the body 200*a* of FIG. 4A or 4C, the open λ/4 transmission line stub 920 having n equal to 2 is serially installed in the upper plate 230. According to the body 200*a*, the serial λ/4 transmission line stub 920 is mounted at, that is, combined with, a coupling point (the feeding point 221) of the metal pole 220, which is a monopole, and the upper plate 230, which is a disk, so that a bandwidth thereof is improved. The serial λ/4 transmission line stub 920 is obtained by connecting three kinds of stub 921, 922, and 923 having different characteristic impedances in series.

In particular, the stub 922 disposed between both ends of, that is, in the middle of, the serial λ/4 transmission line stub 920 may have a larger strip width than the other stubs 921 and 923 at the both ends.

FIG. 4B shows an impedance matching characteristic of the body 200*a* of FIG. 4A.

For example, when a return loss is −10 dB, an impedance bandwidth is about 37 MHz, which is about double the bandwidth of the case of FIG. 3B, which is the comparative example. Also, the body 200*a* may show an omnidirectional characteristic while having a relatively large bandwidth.

Comparing FIGS. 3A and 4A, a user may see that the body 200*a* of FIG. 4A may be obtained by combining the serial λ/4 transmission line stub 920 with FIG. 3A which is any one of antennas with various structures. Also, comparing FIGS. 3B and 4B, a user may see that the bandwidth is relatively increased so that each antenna product may be used in a broadband network in terms of performance, or may see that it is possible to match the bandwidth and a bandwidth of a broadband network. In other words, the serial λ/4 transmission line stub 920 is manufactured in a way described herein and may be very easily applied to or installed in an antenna product having any one of various forms.

The bodies 200 and 200*a* of FIGS. 3A and 4A have the same size of 68φ×13.4 $mm^3$, and the upper plates 230 or the lower plates 210 have almost the same size. The bodies 200 and 200*a* shown in FIGS. 3A and 4A are mounted in the recess 110 of the manhole cover 100, as shown in FIG. 4C, and used.

Referring to FIG. 4C, the present embodiment includes the manhole cover 100, the body 200*a*, and a radome 300.

The manhole cover 100 may be installed on a manhole in a ground surface and may be disposed on a circumferential protrusion in a boundary of an upper hole of the manhole so that the upper hole of the manhole may be covered or opened.

The body 200*a* described above is in the form of a short monopole and exhibits performance as an antenna that has a small difference between a main radiation direction and the ground surface.

The body 200*a* is mounted or installed in the recess 110 and serves to convert an electrical signal into an electromagnetic wave so that wireless communication may be performed with a non-shown gateway that is away from the manhole cover 100.

The radome 300 may be a plastic cover. To cover the body 200*a*, the radome 300 may be inserted in or fill the recess 110 or may be fixed in the recess 110 by a non-shown ring-shaped fixing tool. At this time, the radome 300 may be kept at a level which is the same as or very similar to an upper surface of the manhole cover 100. In other words, the body 200*a* serving as an antenna is covered by the radome 300.

The radome 300 may be formed of a solid non-metallic dielectric. Here, a dielectric is a non-conductor which has a higher permittivity than air. The higher the permittivity is, the easier polarization of a radio frequency (RF) signal becomes. As such a dielectric, polycarbonate, acryl, a ceramic, a printed wiring board (PWB), or teflon may be used.

Since the open λ/4 transmission line stub 920 of the body 200*a* according to the present embodiment may be applied to various forms of general antenna as well as the manhole cover 100, the open λ/4 transmission line stub 920 is not limited to being embedded in the manhole cover 100.

A method of improving a bandwidth of an antenna using a λ/4 transmission line stub according to an application example will be described below.

Figure 5:
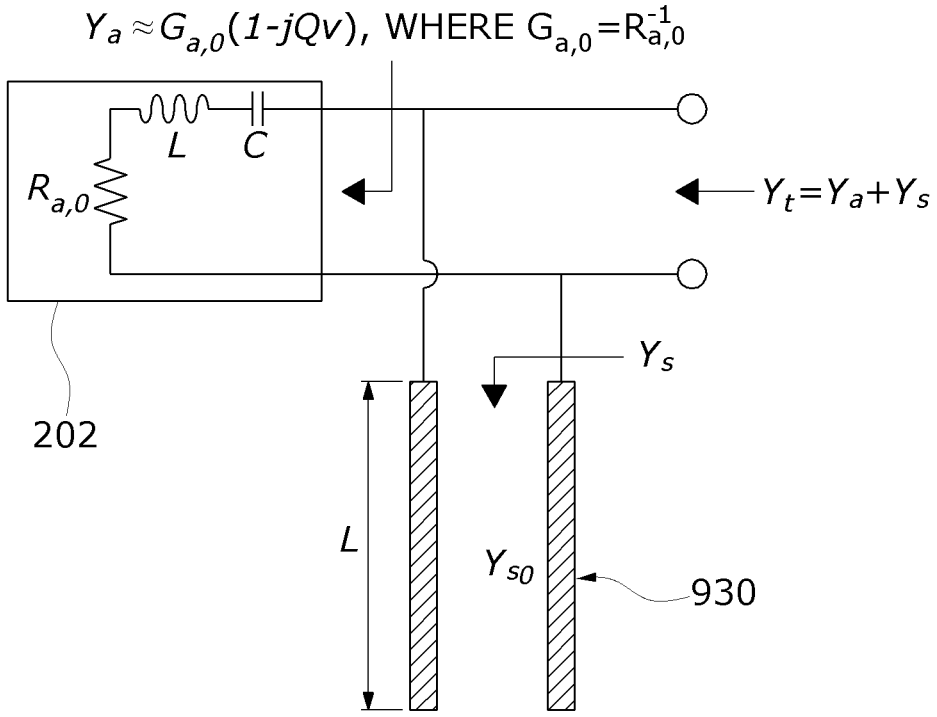
FIG. 5 is a circuit diagram showing a method of improving an impedance bandwidth of an antenna using a parallel λ/4 transmission line stub according to an application example of the present invention.
Figure 6:
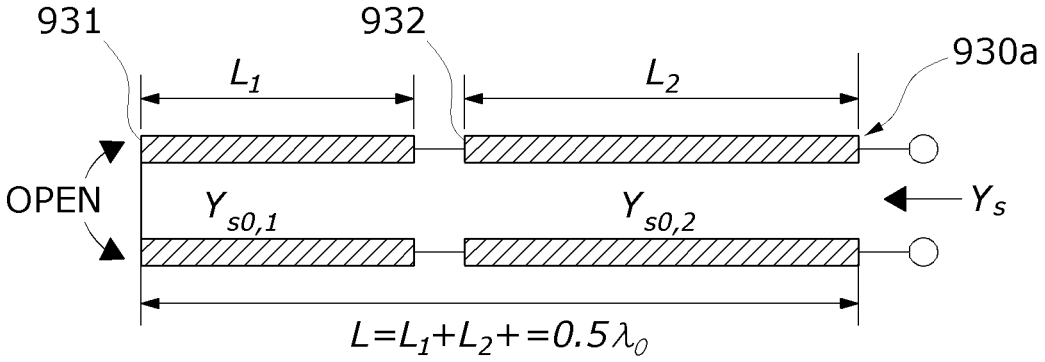
FIG. 6 is a circuit diagram of open λ/4 transmission line stubs that may be applied to the circuit diagram shown in FIG. 5, have different lengths and characteristic admittances, and are composed of serial connections of two kinds of transmission line.
Figure 7A:
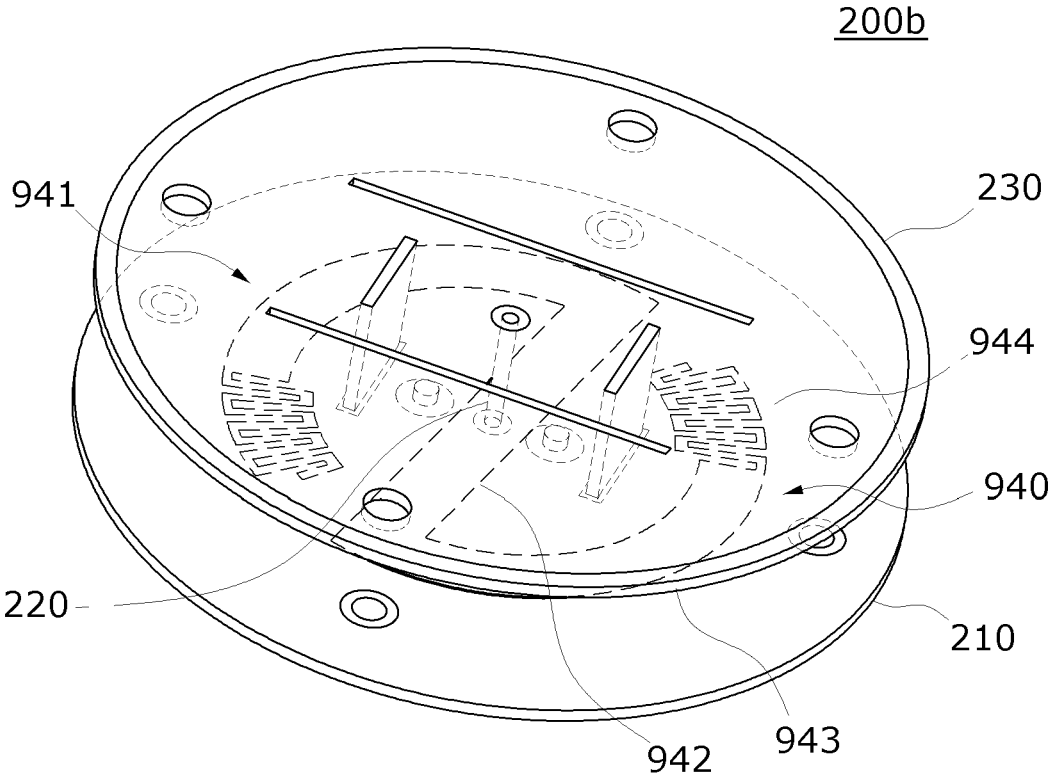
FIG. 7A is a perspective view of a body having a lower plate which is manufactured using a method of improving an impedance bandwidth of an antenna using a λ/4 transmission line stub according to an application example of the present invention and in which open λ/4 transmission line stubs having a positive integer n of 2 are installed in parallel.
Figure 7B:
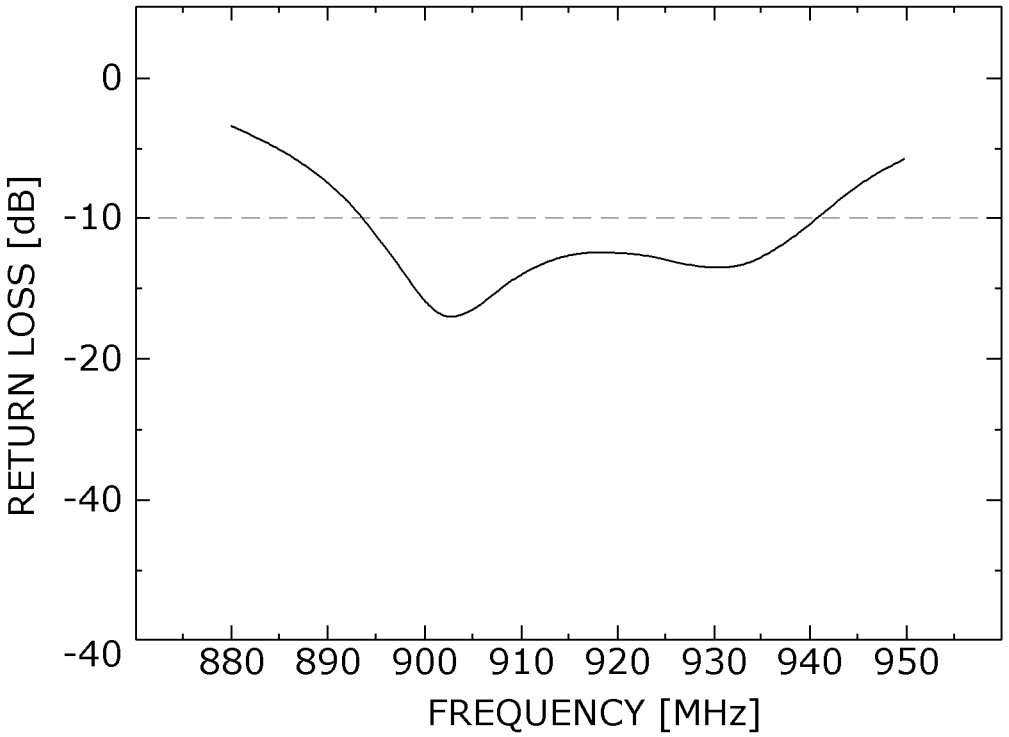
FIG. 7B is a graph showing an impedance matching characteristic of the body shown in FIG. 7A.

FIG. 5 is a circuit diagram showing a method of improving an impedance bandwidth of an antenna using a parallel λ/4 transmission line stub according to an application example of the present invention, and FIG. 6 is a circuit diagram of open λ/4 transmission line stubs that may be applied to the circuit diagram shown in FIG. 5, have different lengths and characteristic admittances, and are composed of serial connections of two kinds of transmission line. FIG. 7A is a perspective view of a body having a lower plate which is manufactured using a method of improving an impedance bandwidth of an antenna using a λ/4 transmission line stub according to an application example of the present invention and in which open λ/4 transmission line stubs having a positive integer n of 2 are installed in parallel, and FIG. 7B is a graph showing an impedance matching characteristic of the body shown in FIG. 7A.

Referring to FIG. 5, an equivalent admittance $Y_a$ of the body 202, which is an antenna, around the resonant frequency $f_0$ may be indicated by Expression 8 below.

$$Y_a \approx G_{a,0}(1 - jQv), \text{ where} \quad G_{a,0} = R_{a,0}^{-1},\ v = \frac{f}{f_0} - \frac{f_0}{f},\ Qv << 1 \quad \text{[Expression 8]}$$

Here, $G_{a,0}$ is a resistance component of an impedance of a resonant antenna, and Q is a quality factor of the antenna. The higher Q is, the smaller a bandwidth of the antenna becomes.

In FIG. 5, parallel λ/4 transmission line stubs 930 connected in parallel with the body 202, which is an antenna, may be short stubs or open stubs.

Here, the λ/4 transmission line stubs 930 may be parallel stubs that have one ends that are open and have a length which is an even-number multiple of λ/4, or parallel stubs that have one ends that are shorted and have a length which is an odd-number multiple of λ/4.

In other words, when the length L of the parallel λ/4 transmission line stubs 930 is $0.25(2n-1)\lambda_0$ or $0.5n\lambda_0$, an admittance of the parallel λ/4 transmission line stubs 930 around the resonant frequency $f_0$ may be indicated by Expression 9 below. Here, n is a positive integer and $\lambda_0$ is a resonant wavelength. The larger n is, the greater the length L of the λ/4 transmission line stubs 930 becomes.

$$Y_s \approx jk_2 v \quad \text{[Expression 9]}$$

Referring to Expression 9 above, when $f=f_0$, $Y_s$ equals 0, and $k_2$ is an inclination of a change in $Y_s$ with respect to a change in v when $f=f_0$.

For example, in the case of a short stub having the length L of $0.25(2n-1)\lambda_0$, an input admittance $Y_S^S$ is indicated by Expression 10 below.

$$Y_s^z = -jY_{s0}\cot\left(\frac{2\pi L}{\lambda}\right)\Big|_{L=\frac{(2n-1)\lambda_0}{4}} \approx jY_{s0}\frac{(2n-1)\pi}{4}v = jk_2 v \quad \text{[Expression 10]}$$

Here, $Y_{s0}$ is a characteristic admittance of a transmission line constituting the λ/4 transmission line stub, and $$k_2 \approx Y_{S0}\frac{(2n-1)\pi}{4},$$

which denotes a positive inclination value.

Meanwhile, an input admittance $Y_S^o$ of an open λ/4 transmission line stub having the length L of $0.5n\lambda_0$ is indicated by Expression 11 below.

$$Y_s^o = jY_{s0}\tan\left(\frac{2\pi L}{\lambda}\right)\Big|_{L=\frac{nl_0}{2}} \approx jY_{s0}\frac{n\pi}{2}v = jk_2 v \quad \text{[Expression 11]}$$

Here, $$k_2 \approx Y_{s0}\frac{n\pi}{2},$$

which denotes a positive inclination value.

A total admittance $Y_t$ of the body 202, which is a serial resonant antenna, and a parallel λ/4 transmission line stub is indicated by Expression 12 below.

$$Y_t = Y_a + Y_s \approx G_{a,0} - jG_{a,0}\left(Q - \frac{k_2}{G_{a,0}}\right)v = G_{a,0}(1 - jQ'v) \quad \text{[Expression 12]}$$

Here, $$Q' = Q - \frac{k_2}{G_{a,0}},$$

which denotes a quality factor of a total antenna admittance.

As described above, $k_2$ has a positive value, and thus Q'<Q. Therefore, a total impedance bandwidth of the antenna increases. When a bandwidth enlargement factor is F, F is indicated by Expression 13 below.

$$F = \frac{Q}{Q'} = \frac{G_{a,0}Q}{G_{a,0}Q - k_2} \quad \text{[Expression 13]}$$

Referring to Expression 13, the larger $k_2$ is, the greater the bandwidth enlargement factor F becomes. Referring back to Expression 10 and Expression 11, when the characteristic admittance $Y_{s0}$ of the λ/4 transmission line stub increases, that is, when n increases (i.e., when the length of the λ/4 transmission line stub increases), $k_2$ increases. Accordingly, the bandwidth enlargement factor F increases.

Meanwhile, $Y_{s0}$ is the characteristic admittance of a transmission line constituting the λ/4 transmission line stub. However, it is unnecessary for the λ/4 transmission line stub to have a uniform characteristic admittance over the entire length L. For example, FIG. 6 shows an example of an open λ/4 transmission line stub 930*a* having n equal to 2. Here, $L=0.5n\lambda_0|_{n=2}=0.5\lambda_0$, and two kinds of transmission line 931 and 932 having different lengths L1 and L2 and characteristic admittances $Y_{s0,1}$ and $Y_{s0,2}$ are connected in series. Here, $Y_{s0}$ of Expression 10 and Expression 11 may be equivalently calculated as functions of the different lengths L1 and L2 and the characteristic admittances $Y_{s0,1}$ and $Y_{s0,2}$, and a variety of optimized combinations for increasing $Y_{s0}$ in a limited design space may be derived. Also, the parallel λ/4 transmission line stub 930*a* may be designed in various ways, which may be devised by those of ordinary skill in the art, that, for example, increase the number of the transmission lines 931 and 932 connected in series or continuously change the characteristic admittances $Y_{s0,1}$ and $Y_{s0,2}$ of the transmission lines 931 and 932.

FIG. 7A shows the body 200*b* according to an application example of the present invention.

The body 200*b* of FIG. 7A may also be installed in the manhole cover 100 together with the radome 300, which is made of a dielectric material, described above in FIG. 4C.

The body 200*b* may also be a disk-loaded monopole antenna which resonates at 920 MHz. When open λ/4 transmission line stubs 940 and 941 of a parallel structure to be described below are not installed, a general impedance bandwidth may be about 18 MHz to about 19 MHz with respect to a return loss of −10 dB due to an impedance matching characteristic.

The body 200*b* of FIG. 7A having an impedance bandwidth, which may be compared with such a general impedance bandwidth, is an example in which the open λ/4 transmission line stubs 940 and 941 having n equal to 2 are installed in parallel at a feeding point 221*a* of the lower plate 210 which is a feeding portion.

In other words, the two open λ/4 transmission line stubs 940 and 941 having the same structure are installed in parallel in the body 200*b* to achieve $$Q' = Q - \frac{k_2}{G_{a,0}},$$

so that a bandwidth is further improved.

Here, the open λ/4 transmission line stub 940 and 941 may include first transmission lines 942 having straight structures symmetrically extending in a diametric directions of the body 200*b* from the feeding point 221*a*, second transmission lines 943 having arc structures extending along a circumferential direction of the body 200*b* from ends of the respective first transmission lines 942, and third transmission lines 944 having meander strip structures formed along the circumferential direction at ends of the second transmission lines 943.

In other words, the open λ/4 transmission line stubs 940 and 941 according to the application example are parallel stubs and are composed of serial connections of transmission lines for a stub having two different characteristic admittances.

FIG. 7B shows an impedance matching characteristic of the body 200*b* of FIG. 7A.

For example, when a return loss is −10 dB, an impedance bandwidth is about 46 MHz, which is about double the bandwidth of the case in which the open λ/4 transmission line stubs having the parallel structure according to the present application example are not installed.

As described above, according to an exemplary embodiment of the present invention, it is possible to reduce a quality factor of an antenna impedance and improve a bandwidth by combining λ/4 transmission line stubs in series or parallel with a feeding portion such as the aforementioned feeding point or the like, and the present invention may be widely applied to antennas with various structures including a dipole antenna and a patch antenna.

Moreover, a λ/4 transmission line stub according to an exemplary embodiment of the present invention has almost no effect on an antenna impedance at a resonant frequency and provides a wideband effect by reducing an inclination of a change in the antenna impedance, that is, a quality factor (Q) of the antenna impedance, depending on a frequency change around the resonant frequency. Therefore, the λ/4 transmission line stub plays a different role from a general stub which is used for impedance matching in an existing RF circuit and has an arbitrary length.

A method of improving a bandwidth of an antenna using a λ/4 transmission line stub according to an exemplary embodiment of the present invention may provide a new method of reducing a quality factor of a total antenna impedance of both a body and a λ/4 transmission line stub by combining the λ/4 transmission line stub in series or parallel with a feeding point of an antenna or a method of designing serial and parallel λ/4 transmission line stubs, and prove the effectiveness thereof by giving an example of bandwidth improvement.

A method of improving a bandwidth of an antenna using a λ/4 transmission line stub according to an exemplary embodiment of the present invention makes it possible to improve and remarkably increase a bandwidth of a body, which is an antenna, by reducing a quality factor of an antenna impedance, and makes it possible to efficiently transmit a broadband signal with a relatively small body.

A method of improving a bandwidth of an antenna using a λ/4 transmission line stub according to an exemplary embodiment of the present invention may be widely applied to antennas with various structures including a dipole antenna and a patch antenna.

Effectiveness of a method of improving a bandwidth of an antenna using a λ/4 transmission line stub according to an exemplary embodiment of the present invention may be proved by giving a method of designing serial and parallel λ/4 transmission line stubs that are combined with a feeding point of a body, which is an antenna, and improve a bandwidth thereof, and giving an example of bandwidth improvement using the method.

A method of improving a bandwidth of an antenna using a λ/4 transmission line stub according to an exemplary embodiment of the present invention may enable wireless communication at a ground position a long distance from a manhole and may help in remotely forming a wireless sensor network or a wide-area wireless communication network of multiple sensors in the manhole and in collecting and managing sensing information collected by the sensors when a flat multi-plate structure having an upper plate and a lower plate which are in parallel with each other and have a metal pole and a short strip interposed therebetween is applied to a manhole cover.

The above description of the present invention is exemplary, and those of ordinary skill in the art should appreciate that the present invention can be easily carried out in other detailed forms without changing the technical spirit or essential characteristics of the present invention. Therefore, exemplary embodiments of the present invention describe rather than limit the technical spirit of the present invention, and the scope of the present invention is not limited by these embodiments. It should be noted that the scope of the present invention is defined by the claims rather than the description of the present invention, and the meanings and ranges of the claims and all modifications derived from the concept of equivalents thereof fall within the scope of the present invention.

What is claimed is:

1. A method of adjusting a bandwidth of an antenna using a transmission line stub, the method being a method of adjusting a bandwidth of a body serving as an antenna and comprising:

combining the transmission line stub in series or parallel with a feeding point, which is an antenna signal input/output point of the body, and applying the transmission line stub to the antenna for wide use, wherein the transmission line stub is obtained by connecting a plurality of transmission lines having respective characteristic impedances corresponding to different lengths, wherein the transmission line stub is obtained by connecting the plurality of transmission lines having the characteristic impedances corresponding to the different lengths in series to increase an impedance bandwidth of the antenna including the body and reduce a quality factor of an antenna impedance or an antenna admittance of the body.

2. The method of claim 1, wherein a number of transmission lines of the transmission line stub connected in series is increased to reduce the quality factor of the antenna impedance or the antenna admittance.

3. The method of claim 2, wherein a characteristic impedance is continuously changed by lengthening or shortening a length of the transmission lines of the transmission line stub connected in series to reduce the quality factor of the antenna impedance or the antenna admittance.

4. The method of claim 1, wherein transmission line stub is a 214 serial transmission line stub combined in series with the feeding point, and a stub positioned between both ends of the serial transmission line stub has a larger strip width than other stubs positioned at the both ends thereof.

5. The method of claim 1, wherein the transmission line stub is an open transmission line stub combined in parallel with the feeding point and includes:

first transmission lines having straight structures symmetrically extending in diametric directions of the body from the feeding point;

second transmission lines having arc structures extending along a circumferential direction of the body from ends of the respective first transmission lines; and third transmission lines having meander strip structures formed along the circumferential direction at ends of the second transmission lines.

6. The method of claim 1, wherein the transmission line stub is a serial stub having one end that is open and having a length which is an odd-number multiple, or a serial stub having one end that is shorted and having a length which is an even-number multiple.

7. The method of claim 1, wherein the transmission line stub is a parallel stub having one end that is open and having a length which is an even-number multiple, or a parallel stub having one end that is shorted and having a length which is an odd-number multiple.

8. A method of adjusting a bandwidth of an antenna using a transmission line stub, the method being a method of adjusting a bandwidth of a body serving as an antenna and comprising:

combining the transmission line stub in series or parallel with a feeding point, which is an antenna signal input/output point of the body, and applying the transmission line stub to the antenna for wide use, wherein the transmission line stub is a serial stub having one end that is open and having a length which is an odd-number multiple, or a serial stub having one end that is shorted and having a length which is an even-number multiple or the transmission line stub is a parallel stub having one end that is open and having a length which is an even-number multiple, or a parallel stub having one end that is shorted and having a length which is an odd-number multiple.

* * * * *